US007157653B1

(12) United States Patent
Cahill

(10) Patent No.: US 7,157,653 B1
(45) Date of Patent: Jan. 2, 2007

(54) MAGNETIC LATCHING SWITCH

(75) Inventor: Brian T. Cahill, Oak Creek, WI (US)

(73) Assignee: Deltrol Controls, Milwaukee, WI (US)

( * ) Notice: Subject to any disclaimer, the term of this patent is extended or adjusted under 35 U.S.C. 154(b) by 0 days.

(21) Appl. No.: 11/230,864

(22) Filed: Sep. 20, 2005

(51) Int. Cl.
*H01H 36/00* (2006.01)
*H01H 35/34* (2006.01)
*H01H 35/26* (2006.01)

(52) U.S. Cl. ..... 200/82 E; 200/83 J; 200/83 L

(58) Field of Classification Search ..... 200/81.9 M, 200/82 E, 83 L
See application file for complete search history.

(56) References Cited

U.S. PATENT DOCUMENTS

| | | | | |
|---|---|---|---|---|
| 3,141,077 | A * | 7/1964 | Beeman | 200/83 L |
| 3,300,703 | A * | 1/1967 | Gold et al. | 320/147 |
| 3,361,999 | A * | 1/1968 | Leinauer et al. | 335/298 |
| 3,440,374 | A * | 4/1969 | Wintriss | 200/81 R |
| 3,575,563 | A | 4/1971 | Russell | |
| 3,824,512 | A | 7/1974 | Glass | |
| 3,898,403 | A | 8/1975 | Grayson et al. | |
| 3,963,887 | A | 6/1976 | Takusagawa et al. | |
| 4,172,971 | A | 10/1979 | Silverwater et al. | |
| 4,273,976 | A | 6/1981 | Wolford et al. | |
| 4,345,879 | A | 8/1982 | Steiner | |
| 4,521,651 | A | 6/1985 | Matsumoto et al. | |
| 5,703,552 | A | 12/1997 | Buffet et al. | |
| 5,730,509 | A | 3/1998 | Eith et al. | |

FOREIGN PATENT DOCUMENTS

| | | |
|---|---|---|
| JP | 61046213 A | 3/1986 |
| JP | 61256234 A | 11/1986 |
| JP | 02223120 A | 9/1990 |
| JP | 03037928 A | 2/1991 |
| WO | WO9409503 | 4/1994 |

* cited by examiner

*Primary Examiner*—Ramon M. Barrera
(74) *Attorney, Agent, or Firm*—Andrus, Sceales, Starke & Sawall, LLP

(57) ABSTRACT

A magnetic latching switch includes a housing having mounted therein a movable electrical control structure normally retained in a first position with a stationary electrical lug structure. The electrical control structure and the electrical lugs are held together by a retaining system including a magnetic arrangement contacted by a biasing arrangement for providing a magnetic biasing force. A diaphragm assembly is movable into direct contact with the magnetic arrangement in response to a predetermined counteracting force exerting an operating force which overcomes the magnetic biasing force, and enables the biasing system to move the contact structure to a second position with the stationary lugs.

16 Claims, 4 Drawing Sheets

MAGNETIC LATCHING SWITCH

FIELD OF THE INVENTION

The present invention relates generally to a magnetic latching switch and, more particularly, pertains to a switch device which is operable to change switching positions in response to a predetermined counteracting force.

BACKGROUND OF THE INVENTION

In certain applications, it is highly desirable to utilize a switch which will effectively alter an operating condition in response to a reaction caused by a pressure change. In one particular application related to the manufacture of hybrid vehicles, power is obtained from battery packs typically comprised of multiple cells in series with a switch within in a common manifold. If a fault occurs in any of the cells, it is critical to discontinue charging in the faulted battery pack so as to avoid an explosion. Each battery is equipped with a disk which ruptures in the presence of a fault and emits pressurized gas.

It is desirable that any pressurized gas is communicated to a pressure switch which will quickly break a normally closed electrical connection with a device connected thereto upon reaching a predetermined critical pressure level. The pressure switch should act as a safety device with an arrangement which will normally maintain electrical engagement between sets of contacts, but will function to immediately snap apart the contacts in the presence of built-up gas pressure. The switch is intended to be manually reset only upon rectifying the fault condition.

SUMMARY OF THE INVENTION

It is a general object of the present invention to provide a responsive switching device which is particularly fast-acting in breaking an electrical connection.

It is also an object of the present invention to provide a safety switch which can be utilized to detect fault in a battery.

It is a further object of the present invention to provide a switch having contacts held in one position and snapped to another position upon the presence of a predetermined counteracting force.

In one aspect of the present invention, a magnetic latching switch includes a housing having mounted therein a movable electrical contact structure normally retained in a first position with a stationary electrical lug structure by a biasing system including a magnetic arrangement contacted by the biasing arrangement for providing a magnetic biasing force. A diaphragm assembly is movable into direct contact with the magnetic arrangement in response to a predetermined counteracting force exerting an operating force overcoming the magnetic bearing force and enabling the biasing system to move the contact structure to a second position with the stationary lugs.

The magnetic arrangement includes a fixed magnet, a fixed core and a movable armature engagable and disengagable with the core. The contact structure includes a movable blade having a set of contacts at opposite ends thereof. The biasing system includes a first spring engaged against the movable blade and a second spring engaged against the armature. A fixed retainer surrounds the core and the fixed magnet, and the second spring surrounds the retainer. A flux washer is disposed beneath the fixed magnet and the retainer. The diaphragm assembly includes a flexible diaphragm attached to a piston having an upstanding piston pin passing through the flux washer and the fixed magnet.

The piston pin is engagable with the armature upon application of the operating force. The housing includes an inlet nozzle having a fluid passageway in communication with one side of the diaphragm. The second spring exerts a second biasing force which is greater than a first biasing force exerted by the first spring. The switch is manually reset by means of a reset pin slidable into and out of the housing and engagable with the armature. The first spring lies in surrounding spaced relationship relative to the reset pin. In the first position, the armature is spaced from the movable blade. Upon application of the operating force, an air gap is created between the armature and the core dissipating the magnetic biasing force and allowing the second biasing force to push the movable blade against the first biasing force and cause movement of the contacts relative to the lug structure. The housing is formed with a cavity for holding the stationary lug structure and the contact structure. The housing includes an end cap having mounting structure adapted to attach the switch to a support.

In another aspect of the invention, a magnetic latching switch includes a housing having a movable electrical contact structure held in a first position with stationary electrical lugs by a first biasing device exerting a first biasing force. A magnetic holding arrangement is provided for normally enabling the contact structure and the stationary lugs to maintain the normally closed, latched position and creating a magnetic force between a fixed magnet and a movable magnet. The magnetic force normally overcomes a second biasing force provided by a second biasing device acting against the movable magnet. A reciprocable piston assembly is attached to a diaphragm movable in response to a predetermined counteracting force acting on one side of the diaphragm and exerting an operating force greater than the magnetic force. A portion of the piston assembly is engagable with the movable magnet upon application of the operating force such that the movable magnet urged by the second biasing device will move the contact structure into a second position with the stationary lugs. A reset pin is movable into and out of the housing and is in constant engagement with the movable magnet. The housing is formed with a chamber for holding the diaphragm assembly. The housing is also formed with a pocket for holding the fixed magnet, a core, a retainer, a flux washer and the second biasing device. The housing is further formed with a cavity for holding the stationary lug structure and the contact structure.

Various other objects features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
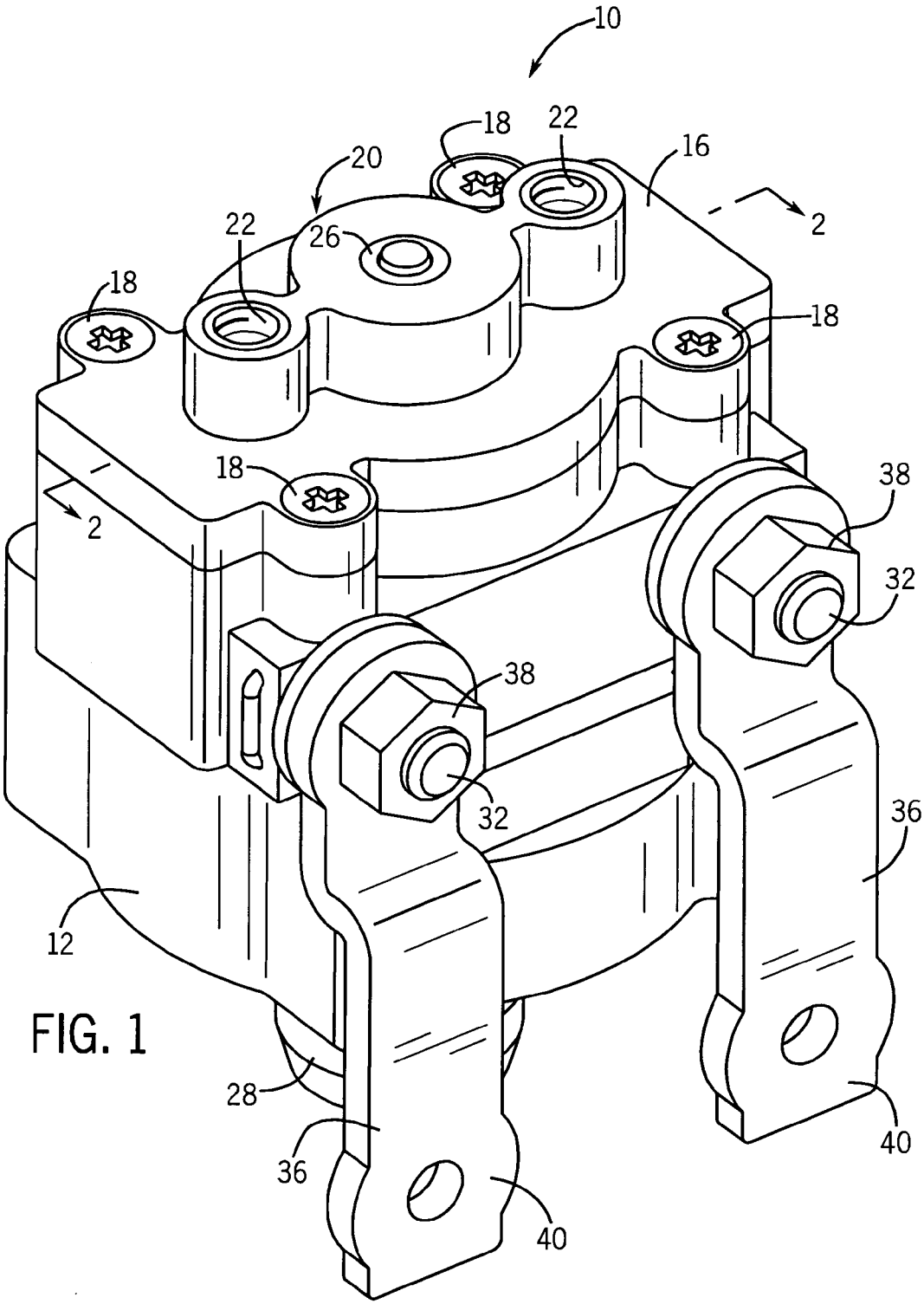
FIG. 1 is a perspective view of a magnetic latching switch embodying the present invention.

Referring now to the drawings, FIGS. 1–4 illustrate a magnetic latching switch 10 in accordance with the present invention.

Figure 2:
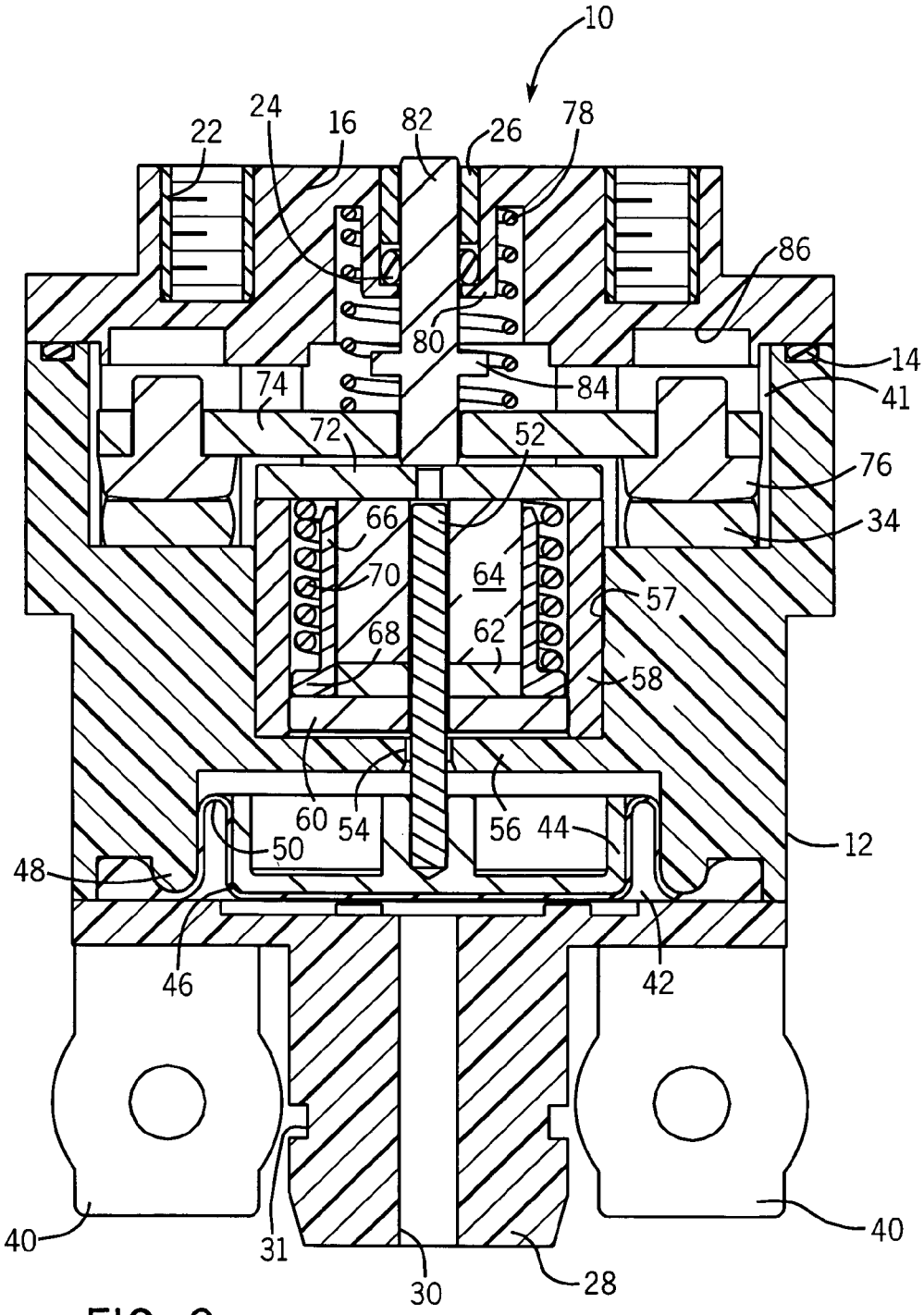
FIG. 2 is a sectional view taken on line 2—2 of FIG. 1 showing the switch in a closed or latched position.

As seen in FIGS. 1 and 2, the switch 10 is comprised of a case or housing 12 provided with a seal 14 at its upper end and joined to an end cap 16 by a set of fasteners 18. The end cap 16 is formed with a riser 20 provided with a pair of cylindrical tapped inserts 22 on opposite ends which are used for mounting the switch 10 to a support surface. The riser 20 includes a recessed central portion for frictionally retaining an O-ring 24 beneath a cylindrical sleeve 26. The bottom of the housing 12 has fastened thereto an inlet nozzle 28 with an inlet passageway 30 for admitting pressurized fluid such as gas which will act as a counteracting force in the switch operation. The exterior of the inlet nozzle 28 is formed with a circumferential groove 31 for frictionally retaining a hose or the like which carries the gas into the switch. A sidewall of the housing 12 has a pair of spaced-apart threaded fastener shafts 32 integral with a pair of stationary electrical lugs 34 protruding outwardly therefrom for mounting a pair of spaced-apart stationary blades 36 thereon. Upper ends of the blades 36 are held in place by nuts 38 screwed upon the shafts 32. Lower ends of the blades 36 have terminal ends 40 which provide an electrical connection for the switch 10. The stationary lugs 34 extend away from the blades 36 and are mounted against a surface of a recessed upper cavity 41 of the housing 12.

As seen better in FIG. 2, the inlet passageway 30 communicates with a chamber 42 formed inside a lower part of the housing 12. A movable piston 44 has a bottom and sidewalls attached to a pressure sensitive means in the form of a flexible diaphragm 46 having peripheral surfaces sealed to an annular ring 48 partially defining the chamber 42. The diaphragm 46 has convoluted portions 50 which lie between the outer sidewall periphery of the piston 44 and the inner sidewall periphery of the chamber 42. As will be appreciated, inlet gas flowing through the passageway 30 into the chamber 42 at a predetermined pressure enables the piston 44 and diaphragm 46 to be vertically displaced in the chamber 42. A cylindrical piston pin 52 extends upwardly in fixed relationship from the piston 44. The piston pin 52 passes through a central hole 54 formed in a wall 56 extending transversely across the housing 12.

The wall 56 defines the bottom of a pocket 57 formed inside the housing 12. Cylindrical internal surfaces forming the pocket 57 fixedly receive a cylindrical shell 58. A flux washer 60 is secured within the lower end of the shell 58, and a permanent magnet 62 of smaller diameter than the flux washer 60 is attached on top of the washer. A cylindrical core 64 having the same diameter as the magnet 62 is rigidly attached to the upper end of the magnet 62. The magnet 62 and the core 64 are inserted within a cylindrical retainer 66 having a radially enlarged base 68. A coiled latch spring 70 surrounds the outside walls of the retainer 66 and has a lower end which rests on the base 68. The latch spring 70 lies spaced inside the internal sidewalls of the shell 58. The flux washer 60, the magnet 62 and the core 64 are formed with aligned apertures and register with central hole 56 for slidably receiving the piston pin 52. The pin 52 moves vertically relative to washer 60, magnet 62 and core 64 according to movement of piston 44 as determined by a predetermined counteracting force such as the inlet gas acting against one side of diaphragm 46.

A movable magnet in the form a metallic armature 72 is disposed in the cavity 41 and is normally held fast against the top of the shell 58 and the core 64 by means of permanent magnet 62. The permanent magnet 62 creates a magnetic flux through the core 64 to hold the armature 72 in contact with the shell 58 against the force of the latch spring 70 which is normally compressed between the base 68 of the retainer 66 and the underside of the armature 72. The magnetic force created by the permanent magnet 62 is greater than the compressive force of the latch spring 70 so that the magnet 62 holds the armature 72 in a closed or latched position shown in FIG. 2.

In this position, a movable blade 74 lies spaced slightly above the armature 72. The bottom of the armature 72 is normally spaced slightly above the top end of the piston pin 52. The ends of the movable blade 74 are provided with electrical contacts 76 which are normally held engaged against the stationary lugs 34 by the force of a coiled contact spring 78. An upper end of the contact spring 78 surrounds a central well 80 formed in the end cap 16 which holds the sleeve 26 and O-ring 24. The contact spring 78 is normally compressed between the end cap 16 and the upper surface of the movable blade 74, and provides a closing force to hold the contacts 76 against the lugs 34. The force of the contact spring 78 is less than the force of the latch spring 70 acting on the armature 72.

A generally cylindrical reset pin 82 is disposed for vertical movement within the interior of the contact spring 78 and is formed with a radially enlarged stop portion 84. As will be appreciated hereafter, the stop portion 84 is engagable with the bottom of the well 80 when the switch 10 is in the fully open, unlatched or disengaged position. The reset pin 82 includes an upper portion which slides through the sleeve 26 and the O-ring 24, and a lower portion which slides through a central opening in the movable blade 74. The bottom end of the reset pin 82 engages the top of the armature 72. In the closed or latched position of FIGS. 1 and 2, the top end of the reset pin 82 protrudes slightly from the riser 20 on the end caps 16.

The switch 10 relies upon the design of a biasing system comprised of the magnet 62, armature 72, latching spring 70 and contact spring 78 in reaction to a counteracting force against diaphragm 46.

Figure 3:
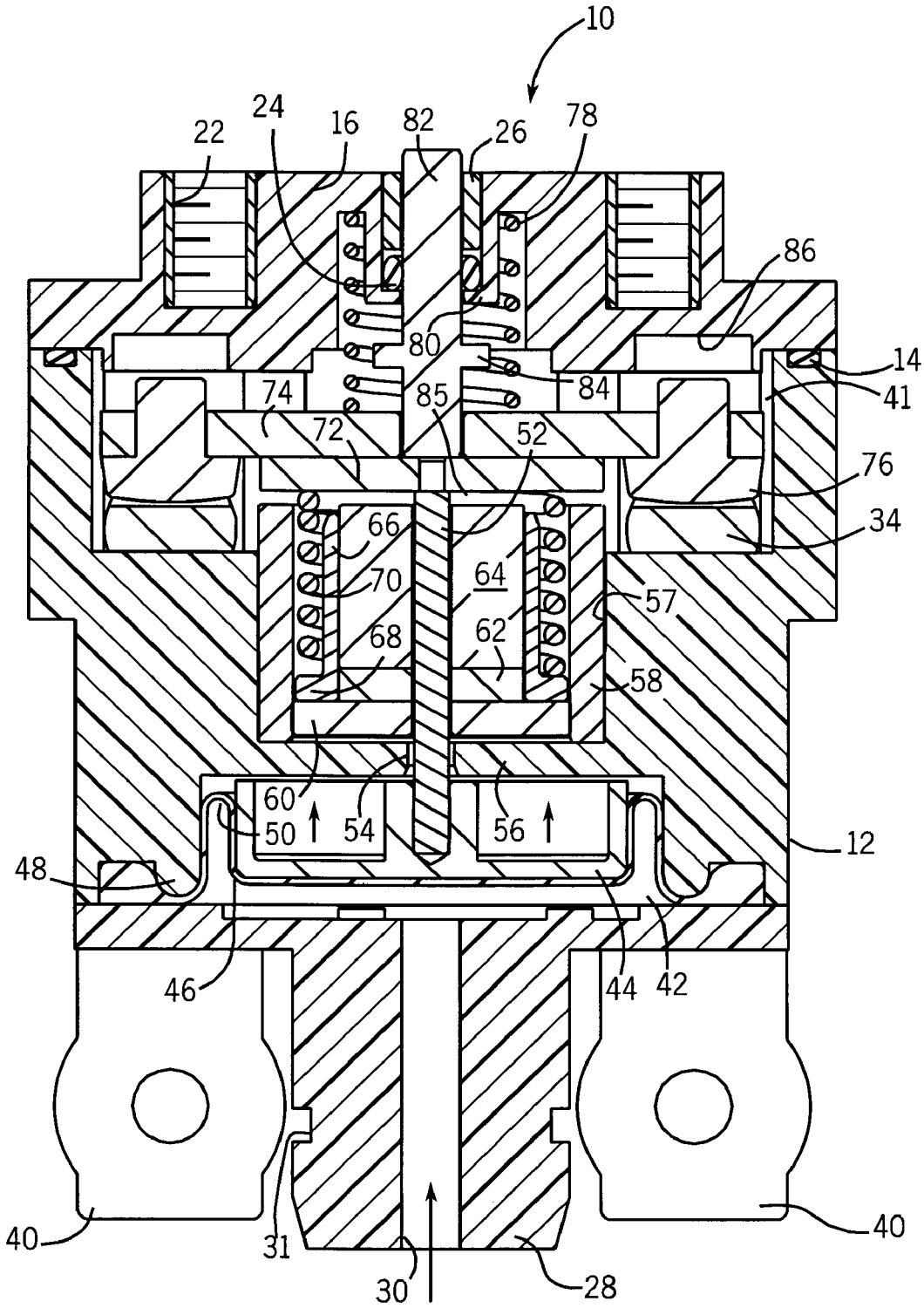
FIG. 3 is a view like FIG. 2 showing the admission of a counteracting force to the inlet of the switch and the initial movement of the internal components in an open or unlatched position.
Figure 4:
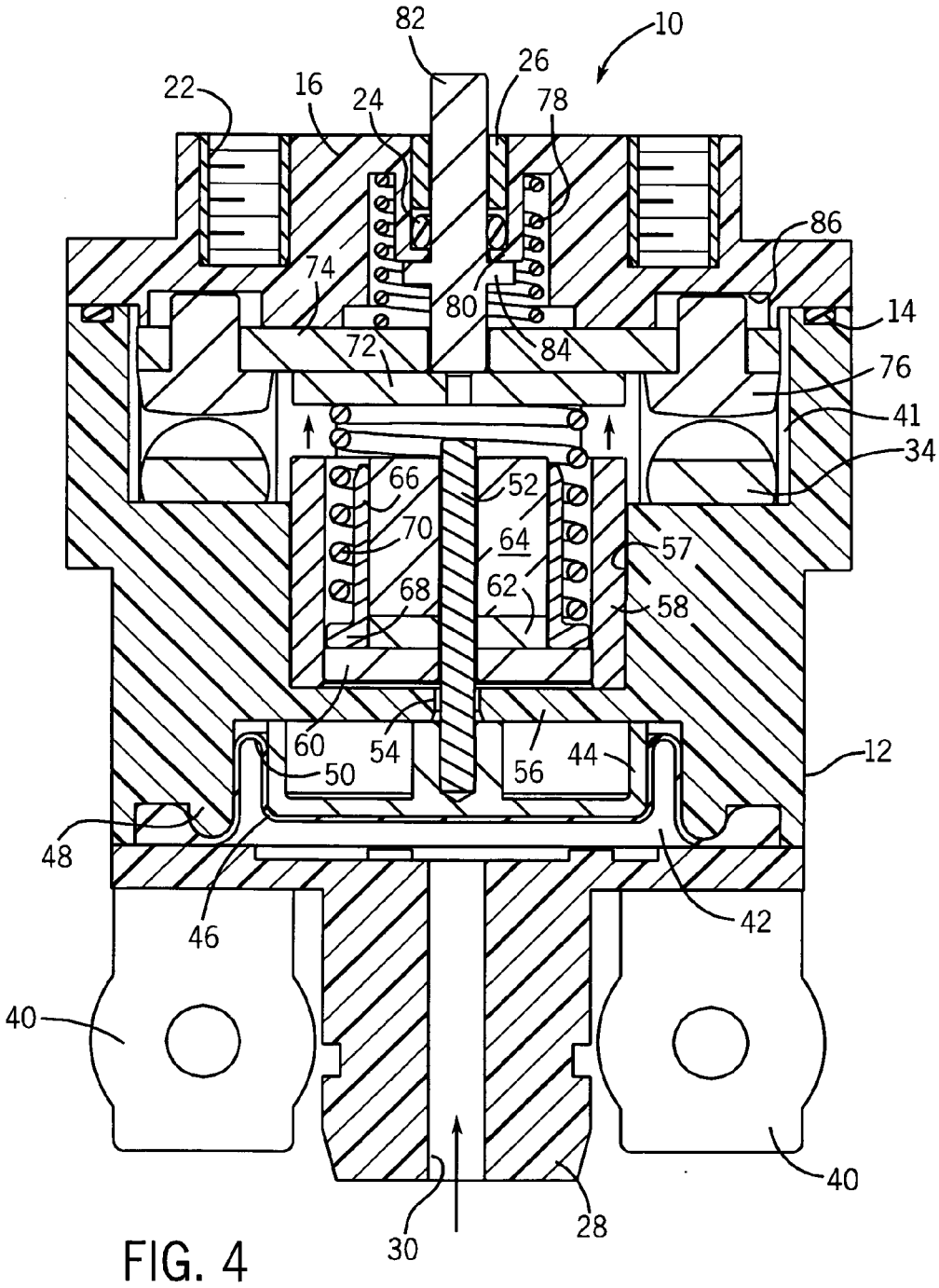
FIG. 4 is another view similar to FIG. 3 showing further movement of the internal components in the open or unlatched position.

In use, the switch 10 is normally in the closed, engaged or latched position of FIGS. 1 and 2 in which the movable contacts 76 are engageable with the stationary lugs 34 and complete an electrical connection for a device connected to the terminals 40. The inlet nozzle 28 is coupled to a hose or the like (not shown) which permits a pressurized gaseous flow into the passageway 30 and the chamber 42 against the diaphragm 46. Should the pressure of the incoming gas increase, the piston 44 elevates and the piston pin 52 is forced upwardly into contact with the armature 72 until the pressure acting on the lower side of the diaphragm 46 exceeds the magnetic holding force between the magnet 62 and the armature 72. The armature 72 is then initially separated from the core 64 and the shell 58 as shown in FIG. 3, and the magnetic force rapidly decreases due to the air gap 85 between the magnet 62 and the armature 72. Once the air gap 85 is created, the compressed latch spring 70 expands forcing the movable blade 74 upwardly so that the contacts 76 quickly separate from the stationary lugs 34 to break the electrical connection and create the open or unlatched position. At the same time, the opening force of the latch spring 70 will overcome the closing force of the contact spring 78 driving the armature 72 against the bottom of the reset pin 82 and into contact with the bottom of the movable blade 74. The piston pin 52 begins moving upwardly and continues to move upwardly as indicated by the arrows in FIG. 4, with the armature 72 of movable blade 74. This movement continues until the stop portion 84 on reset pin 82 engages the bottom of well 80, the top of the movable blade 74 engages depending portions of the end cap 16, and the top ends of the contact 76 engage upper walls 86 of the end cap 16. In this fully open or unlatched condition, the top of the reset pin 82 protrudes more prominently from the top of the switch 10.

Once the gas pressure has properly dissipated below a certain level, the switch 10 is moved back to the closed or latched position by manually pushing down on the top of the reset pin 82 to move the armature 72 against the force of the latch spring 70 and reestablish the holding force between the permanent magnet 62 and the armature 72. This will also allow the contact spring 78 to push the movable blade 74 downwardly and bring the contact 76 into engagement with the stationary lugs 34.

The present invention thus provides a magnetic latching switch which is responsive to a predetermined gas pressure or other counteracting force to overcome a magnetic biasing force and allow a spring member to change the state of an electrical connection.

While the invention has been described with reference to a preferred embodiment, those skilled in the art will appreciate that certain substitutions, alterations and omissions may be made without departing from the spirit thereof. For example, while the preferred embodiment has disclosed the use of gas pressure as a counteracting force, it should be understood that one suitable alternative would be an electrical coil wrapped around the core which, when energized, would create a magnetic field that would oppose the magnetic field of the magnet. Also, while the description indicates that the electrical contacts move from a closed, latched position to an open unlatched position, it should be appreciated that the contacts may also move from an open to a closed position. Accordingly, the foregoing description is meant to be exemplary only and should not be deemed limitative on the scope of the invention set forth with the following claims.

I claim:

1. A magnetic latching switch comprising:

a housing having mounted therein a movable electrical contact structure normally retained in a first position with a stationary electrical lug structure by a retaining system including a magnetic arrangement contacted by a biasing system for providing a magnetic biasing force, and a diaphragm assembly movable into direct contact with the magnetic arrangement in response to a predetermined counteracting force exerting an operating force overcoming the magnetic biasing force and enabling the biasing system to move the contact structure to a second position with the stationary lug structure, wherein the magnetic arrangement includes a fixed magnet, a fixed core and a movable armature engagable and disengagable with the core, wherein the contact structure includes a movable blade having a set of contacts at opposite ends thereof, wherein the biasing system includes a first spring engaged against the movable blade, and a second spring engaged against the armature, and wherein a fixed retainer surrounds the core and the fixed magnet.

2. The switch of claim 1, wherein the second spring surrounds the retainer.

3. The switch of claim 2, wherein a flux washer is disposed beneath the fixed magnet and the retainer.

4. The switch of claim 3, wherein the diaphragm assembly includes a flexible diaphragm attached to a piston having an upstanding piston pin passing through the flux washer and the fixed magnet.

5. The switch of claim 4, wherein the piston pin is engagable with the armature upon application of the operating force.

6. The switch of claim 4, wherein the housing includes an inlet nozzle having a fluid passageway in communication with one side of the diaphragm.

7. The switch of claim 1, wherein the second spring exerts a second biasing force which is greater than the first biasing force exerted by the first spring.

8. The switch of claim 7, wherein, upon application of the operating force, an air gap is created between the armature and the core dissipating the magnetic biasing force and allowing the second biasing force to push the movable blade against the first biasing force and cause separation of the contacts from the lug structure.

9. The switch of claim 1, wherein the switch is manually reset by means of a reset pin slidably into and out of the housing and engagable with the armature.

10. The switch of claim 9, wherein the first spring lies in surrounding, spaced relationship relative to the reset pin.

11. The switch of claim 1, wherein, in the closed, latched position, the armature is spaced from the movable blade.

12. A magnetic latching switch comprising:

a housing having a movable electrical contact structure held in a first position with stationary electrical lugs by a first biasing means exerting a first biasing force, a magnetic holding arrangement for normally enabling the contact structure and the lugs to maintain the normally closed, latched position and create a magnetic force between a fixed magnet and a movable magnet, the magnetic force normally overcoming a second biasing force provided by a second biasing means acting upon the movable magnet, fixed retainer extending around the fixed magnet and surrounded by the second biasing means, a reciprocable piston assembly attached to a diaphragm movable in response to a predetermined counteracting force acting on one side of the diaphragm and exerting an operating force greater than the magnetic force, a portion of the piston assembly being engagable with the movable magnet upon application of the operating force such that the movable magnet urged by the second biasing means will move the contact structure into a second position with the stationary lugs, and a reset pin movable into and out of the housing and in constant direct engagement with movable magnet.

13. The switch of claim 12, wherein the housing is formed with a chamber for holding the diaphragm.

14. The switch of claim 12, wherein the housing is formed with a pocket for holding the fixed magnet, a core, a retainer, a flux washer and the second biasing means.

15. The switch of claim 12, wherein the housing is formed with a cavity for holding the stationary lugs and the contact structure.

16. The switch of claim 12, wherein the housing includes an end cap having mounting structure adapted to attach the switch to a support.

* * * * *